US007775276B2

(12) United States Patent
Pelletier et al.

(10) Patent No.: US 7,775,276 B2
(45) Date of Patent: Aug. 17, 2010

(54) METHOD AND APPARATUS FOR DOWNHOLE SAMPLING

(75) Inventors: Michael T. Pelletier, Houston, TX (US); John C. Welch, Spring, TX (US); Clive Menezes, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 811 days.

(21) Appl. No.: 11/367,924

(22) Filed: Mar. 3, 2006

(65) Prior Publication Data

US 2007/0205021 A1 Sep. 6, 2007

(51) Int. Cl.
*E21B 49/06* (2006.01)

(52) U.S. Cl. ..... 166/264; 166/100; 175/60; 175/233; 73/152.23

(58) Field of Classification Search ..... 166/264, 166/100, 165; 175/58, 60, 233; 73/152.23, 73/152.01
See application file for complete search history.

(56) References Cited

U.S. PATENT DOCUMENTS 2,391,869 A 1/1946 Bandy
2,392,683 A 1/1946 McWhorter
2,511,508 A 6/1950 McClinton
2,595,018 A 4/1952 Stokesbary
2,852,230 A 9/1958 Garrison
2,959,397 A 11/1960 Gardner et al.
3,085,637 A 4/1963 Bennett
3,150,727 A 9/1964 Garrison
3,187,824 A 6/1965 Gauban
3,227,228 A 1/1966 Bannister
3,276,266 A * 10/1966 Auer ..... 73/864.62
3,353,612 A 11/1967 Bannister
3,430,716 A 3/1969 Urbanosky
4,280,568 A 7/1981 McPhee et al.
4,280,569 A 7/1981 Mount, II
4,354,558 A 10/1982 Jageler et al.
4,449,593 A 5/1984 Jageler et al.
4,461,360 A 7/1984 Mount, II
4,466,495 A 8/1984 Jageler
4,609,056 A 9/1986 Colle, Jr. et al.
4,629,011 A 12/1986 Reinhardt
4,714,119 A 12/1987 Hebert et al.
4,950,844 A 8/1990 Hallmark et al.
4,979,576 A 12/1990 Barker et al.
5,310,013 A 5/1994 Kishino et al.
5,411,106 A 5/1995 Maissa et al.
5,439,065 A 8/1995 Georgi
5,445,228 A 8/1995 Rathmell et al.
5,487,433 A 1/1996 Mackay
6,388,251 B1 5/2002 Papanyan
6,412,575 B1 7/2002 Harrigan et al.
6,474,152 B1 * 11/2002 Mullins et al. ..... 73/152.22
6,566,487 B2 5/2003 Buijs et al.
6,581,455 B1 6/2003 Berger et al.

(Continued)

*Primary Examiner*—Jennifer H Gay
*Assistant Examiner*—Brad Harcourt
(74) *Attorney, Agent, or Firm*—Schwegman, Lundberg & Woessner, P.A.

(57) ABSTRACT

An embodiment includes an apparatus that includes a sample carrier adapted to receive a sample and return it to the surface. An embodiment includes a formation tester adapted to load the sample carrier. An embodiment includes a retriever to remove the carrier from the drilling mud. The retriever also includes a device for removing the sample from the carrier.

44 Claims, 12 Drawing Sheets

U.S. PATENT DOCUMENTS

2002/0060094 A1* 5/2002 Meister et al. ..... 175/50
2002/0148643 A1 10/2002 Contreras et al.
2004/0099443 A1 5/2004 Meister et al.
2005/0194134 A1* 9/2005 McGregor et al. ..... 166/264

* cited by examiner

METHOD AND APPARATUS FOR DOWNHOLE SAMPLING

TECHNICAL FIELD

The application relates generally to sampling, more particularly, to sampling in well drilling operations.

BACKGROUND

Monitoring of various parameters and conditions downhole during drilling operations is important in locating and retrieving hydrocarbons, such as oil and gas, from downhole. Monitoring of the parameters and conditions downhole is commonly defined as "logging." Boreholes are drilled through various formations at different levels of temperature/pressure to locate and retrieve hydrocarbons. Accordingly, a number of different sensors and testers are used to monitor the parameters and conditions downhole, including the temperature and pressure, the various characteristics of the subsurface formations (such as resistivity and porosity), the characteristics of the borehole (e.g., size, shape), etc. Such sensors may include electromagnetic propagation sensors, nuclear sensors, acoustic sensors, pressure sensors, temperature sensors, etc. The data generated from the measurements by these sensors can become voluminous (e.g., data related to sonic and imaging information). It is also desirable to sample formation fluids to make decisions on the economic value and manage the reservoir. Samples have been taken down hole, at a separator or in a stock tank. Then samples are shipped to a laboratory, where the fluid is reconstituted to the reservoir conditions. The sample is then separated into a liquid component and a gas component for gas chromatography analysis. It is desirable to extract samples directly from the formation. In this end, formation testers were developed that place a seal on the formation wall and extract fluid from the formation and use the sampled fluids in wireline testing devices. See U.S. Pat. Nos. 5,230,244; 6,843,118; 6,658,930; 6,301,959; and 5,644,076, all assigned to the assignee of the present application and all herein incorporated by reference. Typically testing devices produce samples that must be pumped back to the surface and then tested. Other typical testing devices test downhole and the resulting data is transmitted back to the surface.

Typically, such data and samples may initially be stored in various components downhole. The data is then downloaded from these components to a computing device on the surface for analysis and possible modifications to the current drilling operations. The samples are carried to the surface for testing. A current approach for downloading of this data includes the use of low data rate electrical connections after the downhole drilling tools are pulled out of the borehole. The fluid samples are acquired when the drill string is removed from the bore hole and a wireline tester is inserted into the bore hole.

BRIEF DESCRIPTION OF THE DRAWINGS

Embodiments of the invention may be best understood by referring to the following description and accompanying drawings which illustrate such embodiments. The reference numbers are the same for those elements that are the same or similar across different Figures. In the drawings:

FIGS. 3B and 3C are taken generally along lines 3B-3B and 3C-3C of FIG. 3A, respectively. FIGS. 3D, 3E and 3F are side views of embodiments of the mandrel.

FIG. 4B is taken generally along line 4B-4B of FIG. 4A.

FIGS. 5B and 5C are taken generally along lines 5B-5B and 5C-5C, respectively.

DETAILED DESCRIPTION

Methods, apparatus, and systems for formation fluid sampling, for example with formation tester on a bottom hole assembly (such as a downhole drilling tool) are described. In the following description, numerous specific details are set forth. However, it is understood that embodiments of the invention may be practiced without these specific details. In other instances, well-known circuits, structures, and techniques have not been shown in detail in order not to obscure the understanding of this description.

Figure 1:
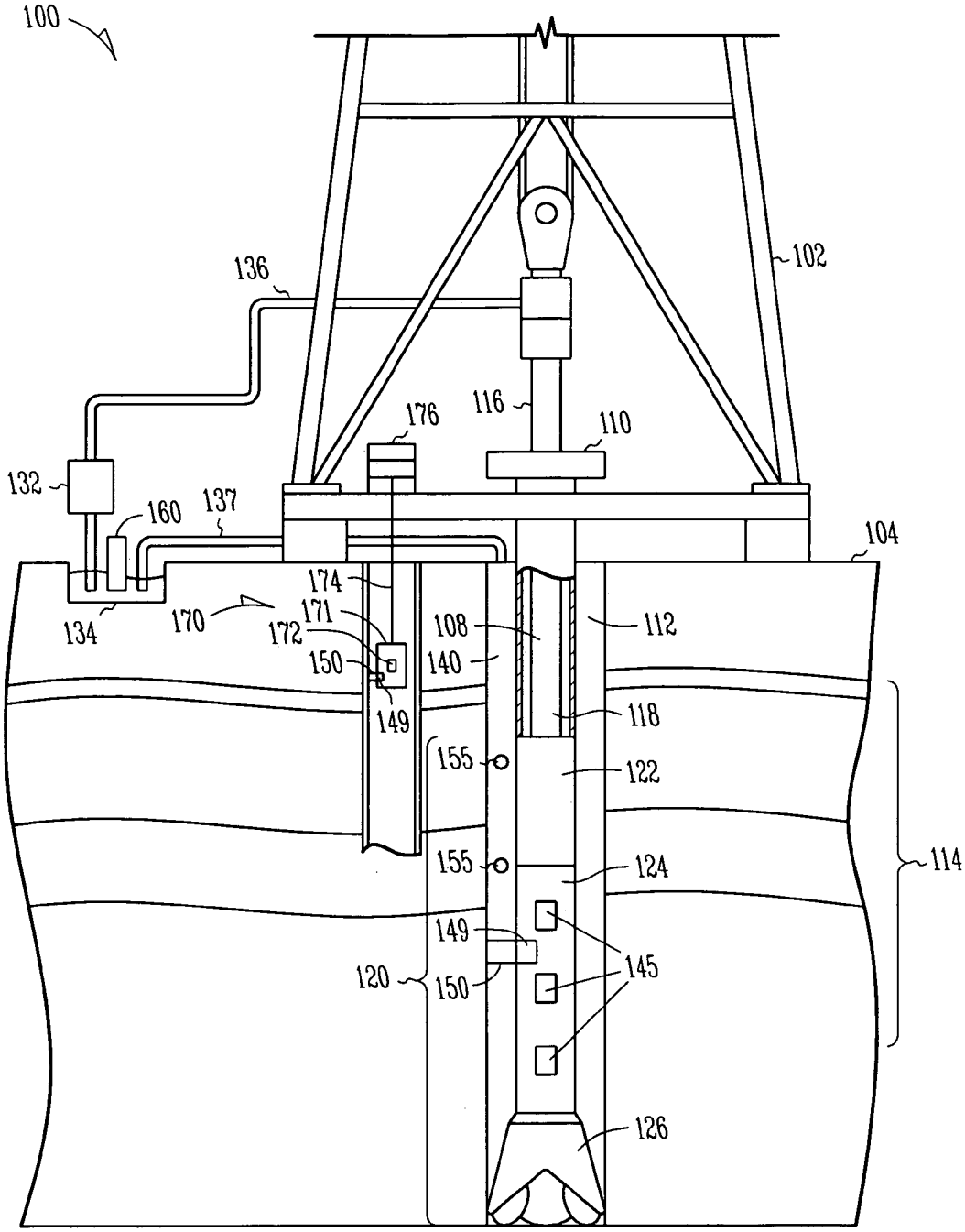
FIG. 1 illustrates a system for drilling operations, according to an embodiment of the invention.

FIG. 1 illustrates a system 100 for drilling operations, according to an embodiment of the invention. System 100 includes a drilling rig 102 located at a surface 104 of a well. The drilling rig 102 provides support for a drill string 108. The drill string 108 penetrates a rotary table 110 for drilling a borehole 112 through subsurface formations 114. The drill string 108 includes a Kelly 116 (in the upper portion), a drill pipe 118, and a bottom hole assembly 120 (located at the lower portion of the drill pipe 118). The bottom hole assembly 120 may include drill collars 122, a downhole tool 124, and a drill bit 126. The downhole tool 124 may be any of a number of different types of tools including measurement-while-drilling ("MWD") tools, logging-while-drilling ("LWD") tools, etc.

During drilling operations, the drill string 108 (including the Kelly 116, the drill pipe 118 and the bottom hole assembly 120) is rotated by the rotary table 110. In addition or alternatively to such rotation, the bottom hole assembly 120 may also be rotated by a motor (not shown) that is downhole. The drill collars 122 may be used to add weight to the drill bit 126. The drill collars 122 also may stiffen the bottom hole assembly 120 to allow the bottom hole assembly 120 to transfer weight to the drill bit 126. Accordingly, this weight provided by the drill collars 122 also assists the drill bit 126 in the penetration of the surface 104 and the subsurface formations 114.

During drilling operations, a mud pump 132 pumps drilling fluid (known as "drilling mud") from a mud pit 134 through a hose 136 into the drill pipe 118 down to the drill bit 126. The drilling fluid can flow out from the drill bit 126 and return back to the surface through an annular area 140 between the drill pipe 118 and the sides of the borehole 112. A hose or pipe 137 returns the drilling fluid to the mud pit 134, where such fluid is filtered. Accordingly, the drilling fluid can cool the drill bit 126 as well as provide for lubrication of the drill bit 126 during the drilling operation. Additionally, the drilling fluid removes the cuttings of the subsurface formations 114 created by the drill bit 126.

Downhole tool 124 includes, in various embodiments, one to a number of different downhole sensors 145, which monitor different downhole parameters and generate data that is stored within one or more different storage mediums within the downhole tool 124. The type of downhole tool 124, and the type of sensors 145 thereon, depend on the type of downhole parameters being measured. Such parameters may include the downhole temperature and pressure, the various characteristics of the subsurface formations (such as resistivity, radiation, density, and porosity), the characteristics of the borehole (e.g., size, shape, and other dimensions), etc. The downhole tool 124 further includes a power source 149, such as a battery or generator. A generator could be powered either hydraulically or by the rotary power of the drill string. The downhole tool 124 includes a formation testing tool 150, which can be powered by power source 149. In an embodiment, the formation testing tool 150 is mounted on a drill collar 122. The formation testing tool 150 engages the wall of the borehole 112 and extracts a sample of the fluid in the adjacent formation. As will be described later in greater detail, the formation testing tool 150 samples the formation and inserts a fluid sample in a sample carrier 155. The size of the sample carrier(s) 155 are shown on an enlarged scale in FIG. 1 for ease and clarity of illustration. The tool 150 injects the carrier 155 into the return mud stream that is flowing intermediate the borehole wall 112 and the drill string 108, shown as drill collars 122 in FIG. 1. The sample carrier(s) 155 flow in the return mud stream to the surface and to mud pit or reservoir 134. A carrier extraction unit 160 is provided in the reservoir 134, in an embodiment. The carrier extraction unit 160 removes the carrier(s) 155 from the drilling mud.

In an embodiment, the down hole tool 124 is coupled to a computing/storage device through a cable that may include optical signal carrier(s) (e.g., fiber optic cable) and electrical signal carrier(s) (e.g., electrical wire). A cable that includes both fiber and wire is referred to as a hybrid cable. The electrical signal carrier(s) therein may be used to provide low-voltage power (e.g., less than about 12 volts and may be intrinsically barriered) to the electronics within the downhole tool 124 to power electronics necessary for the download or upload of data. The electrical signal carrier(s) may also be used as slow speed communication media. The optical signal carrier(s) is used to provide the communication medium for the downloading and uploading of the data. Accordingly, optical (and not electrical) communications are used as data communications within an ambient environment that may include combustible/ignitable gases (e.g., a Class I, Division 1 Area, Zone 0 or Zone 1).

FIG. 1 further illustrates an embodiment of a wireline system 170 that includes a downhole, tool body 171 coupled to a base 176 by a logging cable 174. The logging cable 174 may include a wireline (multiple power and communication lines), a mono-cable (a single conductor), and a slick-line (no conductors for power or communications). The base 176 is positioned above ground and may include support devices, communication devices, and computing devices. The tool body 171 houses a formation testing tool 150 that acquires samples from the formation. In an embodiment, the power source 149 is positioned in the tool body 171 to provide power to the formation testing tool 150. The tool body 171 may further include additional testing equipment 172. In operation, a wireline system 170 is typically sent downhole after the completion of a portion of the drilling. More specifically, the drill string 108 creates a borehole 112. The drill string is removed and the wireline system 170 is inserted into the borehole 112.

Figure 2:
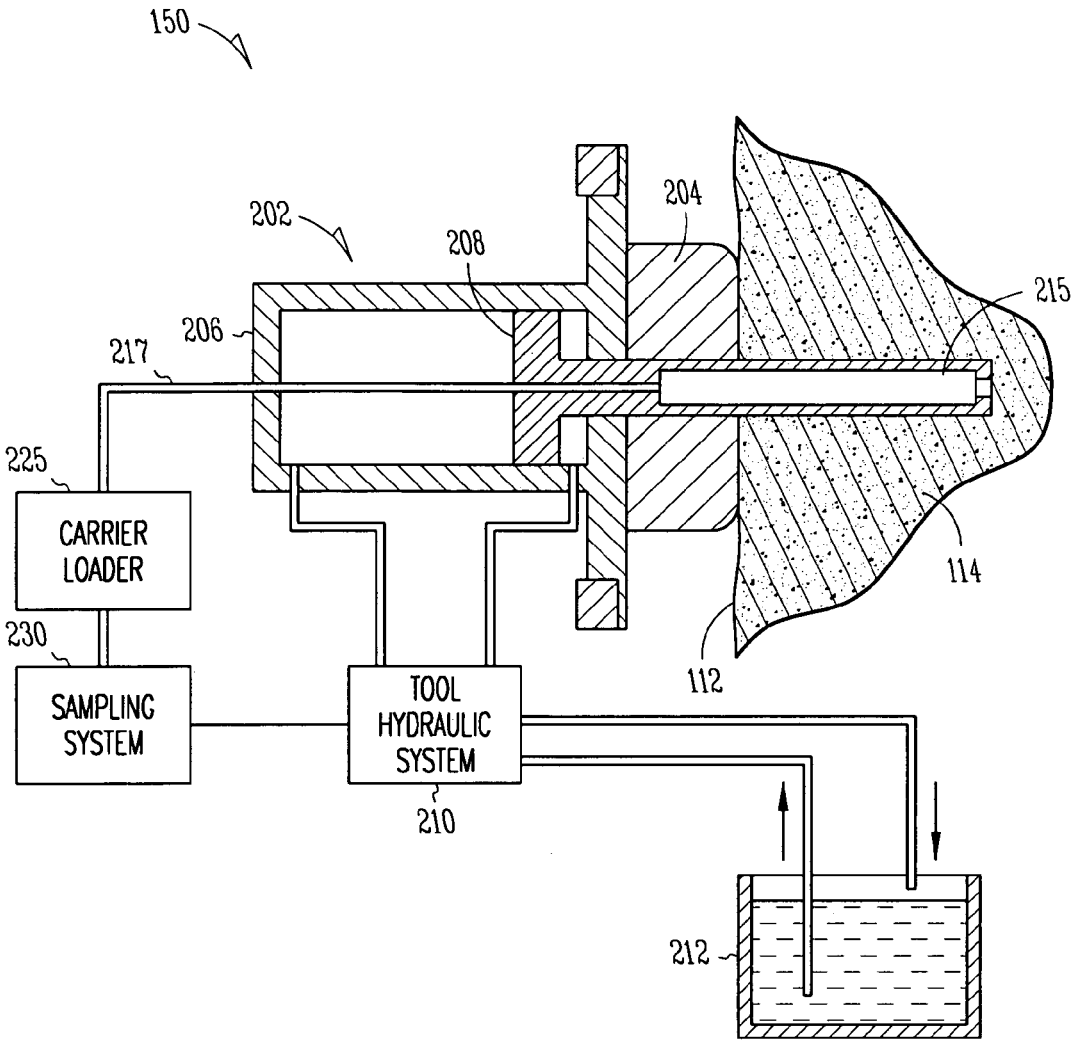
FIG. 2 illustrates a formation testing tool, according to an embodiment of the invention.

FIG. 2 illustrates a formation testing tool 150 according to an embodiment of the invention. A formation testing tool is described in U.S. Pat. No. 5,230,244, which is assigned to the same assignee as the present application and is hereby incorporated by reference for any purpose. Formation testing tool 150 includes housing 202 and a formation wall seal 204. The seal 204 contacts the wall of the borehole 112 and seals out mud flowing in the bore. The housing 202 includes a cylinder 206 with a reciprocating piston 208 within the cylinder 206. A tool hydraulic system 210 is fluidly connected with a hydraulic fluid reservoir 212. Both the tool hydraulic system 210 and the fluid reservoir 212 are housed within the bottom hole assembly 120 in an embodiment. The hydraulic system 210 drives the piston 208 within the cylinder 206 so that the free end of piston arm contacts the formation wall of borehole 112 with an area sealed by the wall seal 204. That is, the piston 208 extends laterally (relative to drill string 108) and essentially perpendicular to the formation wall. A snorkel 215 is positioned on the piston arm and extends into the subsurface formation 114 to obtain formation fluid. The snorkel 215 includes a plurality of apertures to draw the fluid into the snorkel. A further system is described in U.S. Pat. No. 4,745,802 which is owned by the assignee of the present disclosure and incorporated by reference for any purpose. The snorkel 215 is, in an embodiment, fluidly connected to a sample line 217. The sample line 217 extends through a carrier loader 225. A sampling system 230 is connected to the sample line 217 downstream of the carrier loader 225.

In operation, the piston 208 drives the snorkel 215 into contact with the subsurface formation 114. In the illustrated embodiment, the snorkel 215 penetrates into the formation 114. In an embodiment, the snorkel 215 contacts the formation wall but does not penetrate into the formation 114. The sampling system 230 induces a reduced pressure in the sample line 217 that is less than the fluid pressure in the formation. Accordingly, fluids flow from the formation into the apertures of the snorkel 215 and into the sample line 217.

The sample line 217 delivers fluid to be sampled into the carrier loader 225. The carrier loader 225 loads fluid samples into sample carrier(s) 155. Carrier loader 225 releases, in an embodiment, the loaded sample carrier into the mud stream. In a further embodiment, the carrier loader returns the loaded sample carrier to its storage location, (e.g., in a magazine or other carrier holder). Structure and operation of the carrier loader 225 will be explained in greater detail below. It will be understood that the sampling system 230 includes a computer and/or other control systems to control the tool hydraulic system 210 and the carrier loader 225 in an embodiment.

FIGS. 3A, 3B, 3C, and 3D illustrate views of a mandrel 300 for a sample carrier 155 according to embodiments of the invention. The mandrel 300 includes a sample receiving volume or recess 310. In an embodiment illustrated in FIG. 3A, the mandrel 300 has a center body 305 having an elongate, barbell shape with a reduced diameter waist that defines a central annular recess 310. The recess 310 rings the central part of the body 305 and has a smooth arcuate surface in longitudinal cross section. That is, the mandrel 300 at the recess is a solid elliptical hyperboloid in an embodiment. The body 305 has solid cylinders at each end of the recess 310. Cylindrical extensions 312 extend outwardly from each end of body 305. The cylindrical extensions 312 are solid and have a diameter less than the body 305. Caps 314 are positioned at the outward ends of the extensions 312. Caps 314 are solid, in an embodiment, and have a larger diameter than the extensions 312 and the same diameter as the largest diameter of the center body 305. The lateral surfaces of body 305 and caps 314 at extensions 312 form annular recesses 316. A sealing ring 318 is positioned in each of the recesses 316. In an embodiment, the sealing rings 318 are O-rings. In an embodiment, the sealing rings 318 are polymers. In an embodiment, the sealing rings include polytetrafluoroethylene (PTFE) or perfluoroalkoxy polymer resin (PFA). The body 305, extensions 312, and caps 314 are machined from a single ingot of metal in an embodiment. The metal can be aluminum, steel, or titanium, including alloys thereof. The body 305, extensions 312, and caps 314 are fabricated of a material that can withstand the pressure, temperature, and corrosive environment found in a drill hole and are not reactive to either solvents used in testing the samples or with crude oil samples. The dimensions of the mandrel 300 are ½ inch in length and ⅛ inch in diameter, at its largest, in an embodiment. The recess 310 forms a volume of about 70 microliters. In an example, the mandrel 300 is fabricated from a transparent material. In an embodiment, transparent refers to optically transparent. Transparency as it relates to the mandrel 300 refers to the mandrel being transparent to the signal used to analyze a sample held by the mandrel 300 as explained in greater detail below.

Figure 3A:
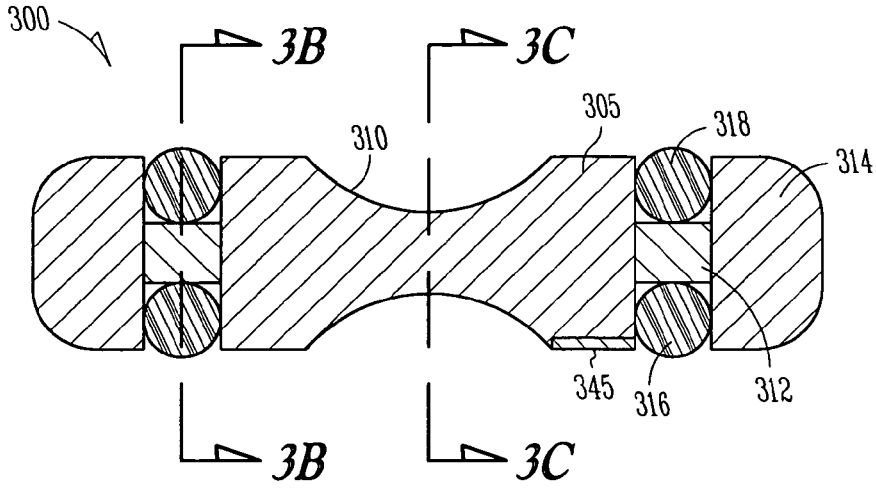
FIGS. 3A, 3B, 3C, 3D, 3E, and 3F illustrate views of a mandrel for a sample carrier, according to an embodiment of the invention.
Figure 3B:
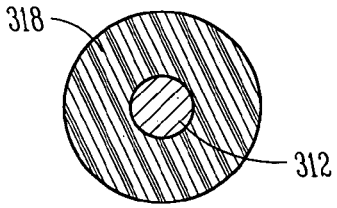
Figure 3C:
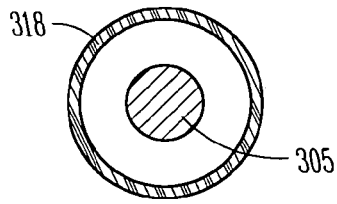
Figure 3D:
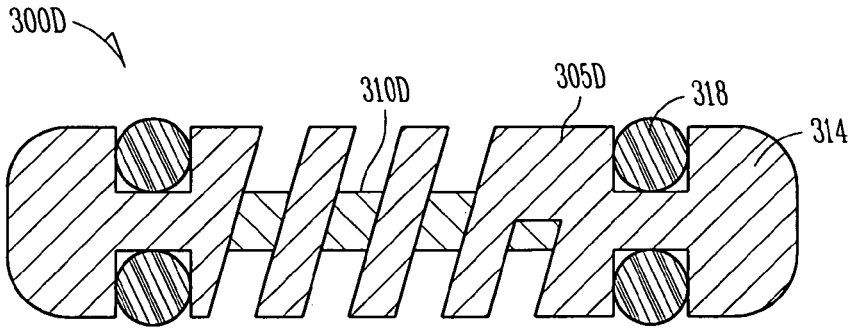
Figure 3E:
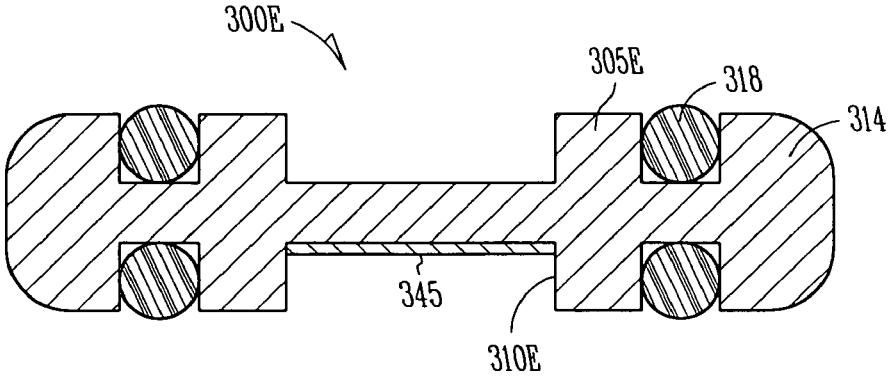
Figure 3F:
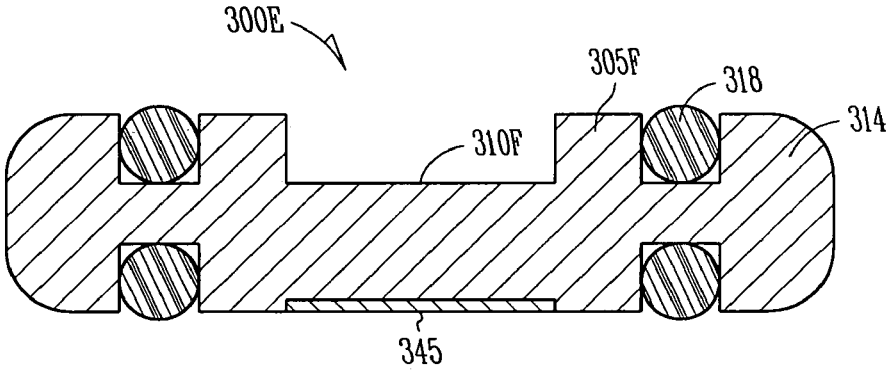

FIGS. 3D, 3E and 3F illustrate embodiments of the mandrel similar to embodiments described above. FIG. 3D shows a mandrel 300D with a different recess 310D. Recess 310D is a spiral recess that winds around the body 305D intermediate the seals 318 and the end caps 314. FIG. 3E shows a mandrel 300E with a recess 310E having a cylindrical shape defined around the body 305E intermediate the seals 318 and the end caps 314. FIG. 3F shows a mandrel 300F with a recess 310F defined only in one side of in the body 305F intermediate the seals 318 and the end caps 314. Specifically, the recess 310F is a slot that does not extend annularly around the body 305F. It will be recognized that any recess in the mandrel body 305 could be used to hold a sample and remain within the scope of the present invention.

Figure 3G:
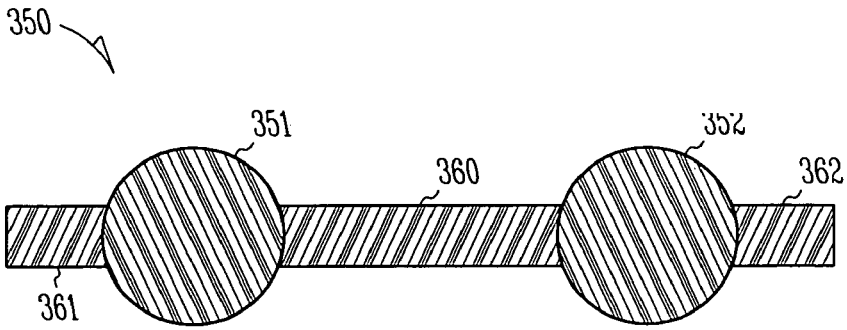
FIG. 3G illustrates a sealing insert for a sample carrier according to an embodiment of the invention.

FIG. 3G illustrates an embodiment of a sealing insert 350 that can be used in the sample carrier 155 as described herein in place of a mandrel. Sealing insert 350 includes at least seals 351, 352 joined together by an elongate link 360. The seals 351, 352 operate to seal the ends of the housing sleeve 400 to hold a sample between the seals interior to the sleeve 400 (sleeve 400 is described in greater detail below). The seals 351, 352 are shown as spheres and may be an elastomer such that the seals can elongate under tension. The tension can be supplied by gripping ends 361, 362, which extend from the seals 351, 352, respectively. The ends 361, 362 are flexible yet strong lengths of material adapted to survive the borehole environment and transfer tension force to the seals 351, 352. In an embodiment, the ends 361, 362 are elastomer material. In an embodiment, the link 360 is also an elastomer. In an embodiment the link 360 is flexible. Other embodiments of the link 360 include a rigid material, such as a metal bar or rigid elastomer. The sealing insert 350 is engineered to provide a release valve operation, i.e., the seals 351 or 352 are selected to slowly leak sample content held within the sleeve 400 by the insert 350 to prevent an abrupt, potentially hazardous release of all of the sample contents at once under uncontrolled conditions.

Figure 4A:
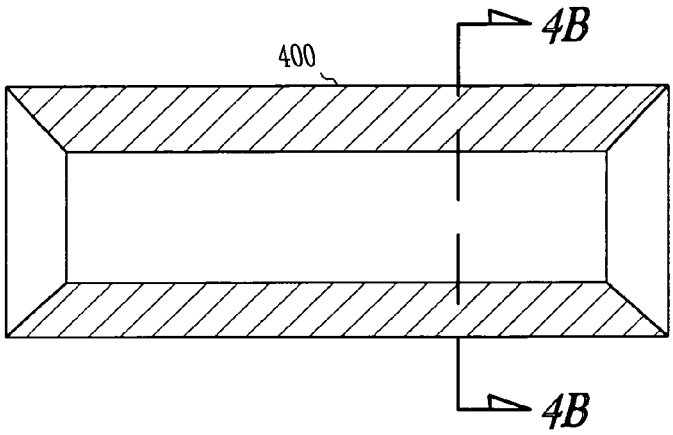
FIGS. 4A and 4B illustrate views of a sleeve for a sample carrier, according to an embodiment of the invention.
Figure 4B:
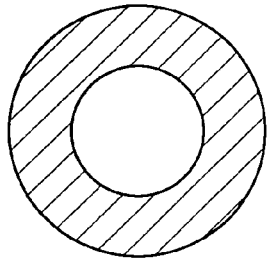

FIGS. 4A and 4B illustrate a sleeve 400 for a sample carrier 155 according to an embodiment of the invention. Sleeve 400 is generally a hollow, open-ended cylinder having an inner diameter slightly larger than the outer diameter of the mandrel 300. The open ends of the cylinder are beveled to provide a sealing seat for use against another surface. The sleeve 400 receives the mandrel 300 in the interior such that the sleeve allows reciprocal movement of the mandrel with the sealing rings 318 fluidly sealing the sample recess 310 when the mandrel is in the sleeve. Like the mandrel 300, the sleeve 400 is fabricated of a material that can withstand the pressure, temperature and corrosive environment found in a bore hole and is not reactive to either solvents used in testing the samples or with crude oil samples. In an embodiment, the sleeve is a metal, such as aluminum, steel, or titanium, including alloys thereof.

Figure 5A:
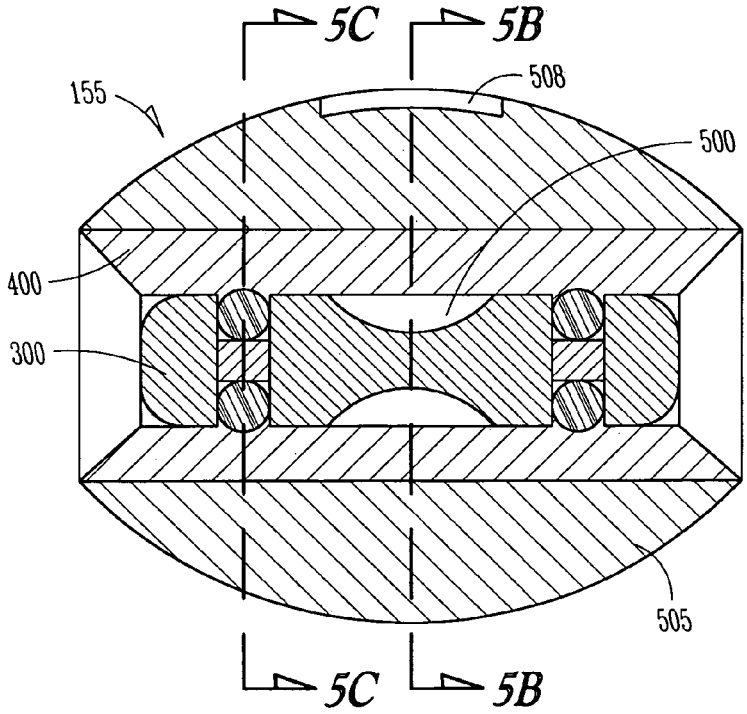
FIGS. 5A, 5B, and 5C illustrate a sample carrier according to an embodiment of the invention.
Figure 5B:
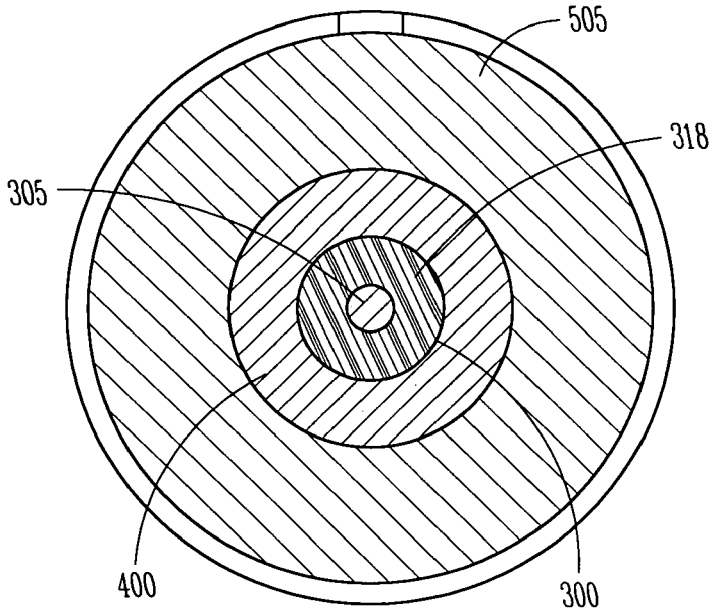
Figure 5C:
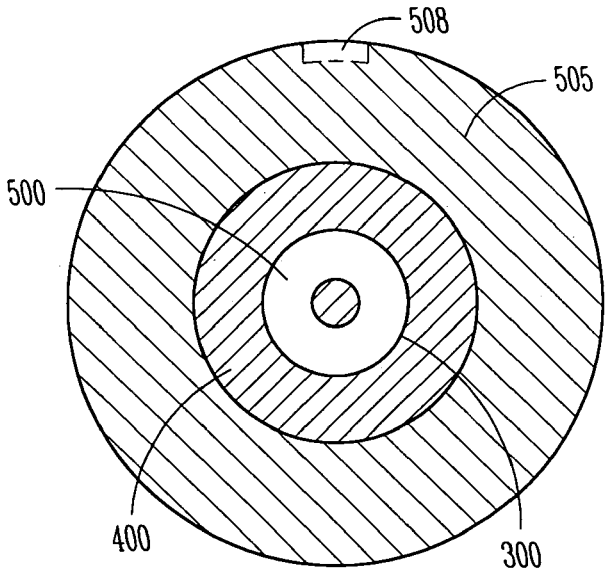

FIGS. 5A, 5B and 5C illustrate a sample carrier 155 according to an embodiment of the invention. The sleeve 400 and jacket 505 form a shell. In an embodiment, the shell is a single piece construction. The mandrel 300 is shown mounted in the sleeve 400. A sample fluid 500 is in the recess 310 when the sample carrier 155 is loaded with a sample. The sleeve 400 is fixed in an outer jacket 505. The outer jacket 505 has a hollow cylindrical interior such that the sleeve is press fit into the interior. In an embodiment, the jacket 505 has a spheroid shape. The jacket 505 has a smooth outer surface and shape to reduce resistance when traveling in the drilling mud. The jacket 505 thereby reduces the likelihood that the sample carrier will become lodged somewhere in the annulus between the drill string 108 and wall of bore hole 112. The jacket 505 is further made for ease of identification in, and removal from, the mud stream. In an embodiment, the jacket 505 is fluorescent to aid in the retrieval of the carrier 155 from the drilling mud. The jacket 505 is buoyant relative to the drilling mud in an embodiment. In an example, the jacket 505 is polyurethane, which is buoyant in 12 ppg drilling mud. The jacket 505 will cause the sample carrier 155 to be buoyancy-neutral relative to the drilling mud. A neutral buoyancy will assist in the transit of the sample carrier 155 to the surface and recovery of the sample carrier at the surface.

The jacket 505 includes an identifier 508 that uniquely identifies the sample carrier relative to the other sample carriers. The identifier 508 is a unique code, such as a mechanical code, electrical code, or electrochemical code. In an embodiment, the identifier is a bar code imprinted on the jacket 505. In an embodiment, the identifier is a radio frequency identification tag ("RFID") mounted in the jacket 505. RFID is a read-write integrated circuit in an example. The RFID is 2.5 mm×2.5 mm and can store at least a kilobyte of digital information. It will be recognized that in some applications of the sample carrier it is desirable to have storage of greater than one kilobyte. The RFID further includes an on-board antenna to enable wireless RF communication. Thus, the RFID can act as a stand alone data carrier. Accordingly, the sample carrier 155 can carry data stored in the RFID chip back to the surface in addition to carrying fluid samples. In an embodiment, the downhole tool 124 writes data, for example, data acquired by its sensors, to the RFID before the sample carrier is ejected into the mud stream. Examples of data include tens of feet of gamma logs, temperature, pressure, depth, flow rates, density, sensed formation properties, viscosity, contamination levels, and any other data measured down hole. It will further be recognized that other types of data storage that could be integrated into the sample carrier 155 is within the scope of the present invention. Such data storage provides adequate communication bandwidth for measurement-while-drilling applications.

The sample carrier 155 is constructed of any suitable material (e.g., aluminum, steel, titanium, etc.) that can withstand the rigors of its environment. The sample carrier 155 is constructed to withstand pressures of at least 30,000 psi and temperatures up to about 500 degrees F. In an embodiment, the sample carrier 155 is, at least partly, constructed of a semicompliant material, such as a resilient polymer. The sample carrier 155 has a size that enables it to be positioned in a producing formation or in an annulus between a well casing and a well bore such that it is freely movable therein. That is, the smooth, rounded outer surface (i.e., barrel shape) and dimension of the carrier ensure that it does not bridge the space from the bore hole wall to the drill string, and will not snag on bore hole wall or drill string. In an embodiment, the carrier 155 has a length of about ⅝ inch, which is its largest dimension. The width of the carrier is less than the length, for example, 0.5 inch or less, in an embodiment. While the shape of the sample carrier 155 is illustrated as oblate, other embodiments of generally spherical or generally prolate spherical shapes are also well-suited for the sample carrier 155. It will be recognized that any shape that will accommodate the necessary volume for holding a sample and facilitate placing the carrier 155 down the bore and into the mud stream may be used as well. As the carrier 155 is released into the mud stream, it is desirable that the carrier 155 be drillable so that in the event a carrier 155 in the mud stream contacts the drill bit 126, the carrier will not interfere with the operation of the drill bit. It will be recognized that the disclosed dimensions for parts of the carrier 155 may be modified for different drilling environments. In any event, it is desirable for the carrier 155 to have a density similar to, or less than, the density of drill cuttings. For example, drill cuttings that have a density of about 2.6 gm/cc are brought to the surface by a combination of mud flow and rheology of the mud system. Accordingly, the carrier 155 should have about the same, or less, density as the drill cutting. In this example, the carrier 155 with sample should have a density of less than about 2.6 gm/cc.

In an embodiment, the carrier 155 includes a chemical coating that attaches to a particular substance (e.g., a hydrocarbon). In an embodiment, the jacket 505 includes the coating. In an embodiment, the mandrel 300 includes the chemical coating 345 (FIG. 3F). The chemical coating can be positioned anywhere on the mandrel 300 shown in FIGS. 3A-3G where the mandrel comes into contact with a formation fluid. In an embodiment, the chemical coating is positioned on the body 305 intermediate the seals 318. Thus, when the carrier 155, i.e., mandrel 300 or jacket 505, is immersed into the formation fluid, the chemical that coats the carrier 155 attaches to a specific component of the formation fluid. The carrier 155 is then discharged into the mud flow and carried to the surface for evaluation. In one embodiment, the coatings may be color coded wherein carriers 155 of a particular color or color code are released from a particular depth or position within a bore hole, thereby correlating depth or position within the bore hole with the hydrocarbon that is attached to the chemical coating of carrier 155. In one embodiment, the carrier 155 may be made from a ferro magnetic substance with a chemical coating thereon. Upon reaching the surface one or more magnets may be arranged to collect the carriers 155 with the attached hydrocarbon. In an embodiment, the coating is a type of chemical test strip. Such a test strip provides an indication of the presence of a specific chemical compound in the formation fluid. The indication can be a change in color based on the presence of the chemical compound. The indication may further provide a quantitative indication of the test chemical compound.

Figure 5D:
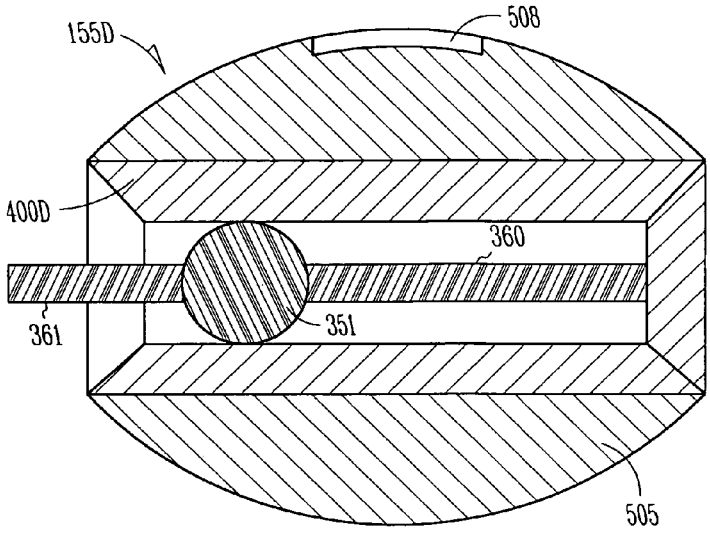
FIG. 5D illustrates a view of a sample according to an embodiment of the invention.

FIG. 5D illustrates a further embodiment of the carrier 155D. Like elements shown with carrier 155D are designated with the same reference numbers as used herein. Elements that are similar to other elements but have some changes are designated with the same reference numbers with a suffix "D." A sealing insert 350D has a first end fixed to the closed end of the sleeve 400D. Insert 350D includes at least one seal 351 joined to by an elongate link 360. The seal 351 operates to seal the ends of the sleeve 400D to hold a sample in the interior to the housing 400D. The seal 351 is shown as a sphere, however, other shapes could be used without departing from the present invention. Seal 351 may be an elastomer such that the seals can elongate under tension. The tension can be supplied through a gripping end 361, which extends from the seal 351. The gripping end 361 is made of flexible yet strong lengths of material adapted to survive the bore hole environment and transfer tension force to the seal. In an embodiment, the end 361 is an elastomer material. In an embodiment, the link 360 is also an elastomer. In an embodiment the link 360 is flexible. Other embodiments of the link 360 include a rigid material, such as a metal bar or rigid elastomer. The sealing insert 350D is engineered to provide a release valve operation, i.e., the seal 351, are selected to slowly leak or leach sample content held within the housing 400D by the insert 350D to prevent an abrupt, potentially hazardous release of all of the sample contents at once under uncontrolled conditions. The housing sleeve 400D is in a jacket 505. Sleeve 400D is generally a hollow, single open-ended cylinder having an inner diameter less than the steady state outer diameter of seal 351 such that seal 351 can hold a sample in the interior of sleeve. In operation, the end 361 is gripped and pulled outwardly away from the open end of the sleeve 400D. The seal 351 elongates to allow insertion or removal of a sample to or from the interior of the sleeve.

FIGS. 6A through 9B illustrate a sequence of the carrier loader 225 loading a sample carrier 155. FIGS. 6A, 7A, 8A, and 9A show the loader 225 and sample carrier 155. Only a single sample carrier 155 is shown for clarity of illustration and ease of understanding. It will be recognized that a plurality of sample carriers are stored in the sample loader in an embodiment. For example, hundreds of sample carriers are stored in a magazine. The magazine is a rotary magazine in an embodiment and when a carrier 155 is loaded and released into the mud flow, another carrier is positioned for loading a sample into the carrier 155. In an embodiment, the magazine is a linear magazine. In a further example, the carrier loader 225 includes a plurality of magazines to further expand the number of sample carriers 155. The greater the number of sample carriers 155 downhole on the drill string 108, the greater the number of samples that can be taken. This will result in a high frequency or data resolution provided by the sample carriers 155. In a further example, the sleeve 400 and jacket 505 are housed in a first magazine and the mandrel 300 is housed in a second magazine. FIGS. 6B, 7B, 8B, and 9B show the cross section of the sample line 217 at the loading point of the loader 225.

Carrier loader 225 has a drive assembly 610 and a loading assembly 620. The drive assembly 610 includes a movable drive collar 612 with a center aperture and a plunger 614 journaled through the center aperture of collar 612. Collar 612 has an engagement side that generally matches the outer dimensions of one side of the carrier 155. The plunger 614 has a diameter generally equal to or less than the diameter of the mandrel 300 at least over an end segment of the plunger 614. This end segment has a seal 616 adjacent its end. Drive assembly 610 further includes a drive for laterally moving the collar 612 and plunger 614. The drive assembly 610 may powered by electrical power, e.g., a battery or wireline power in an embodiment. Drive assembly 610 is hydraulically powered in an embodiment. The drive assembly 610 can also be powered by a pneumatic system. Any of these systems can be powered by the rotary movement of the drill string 108 or flow of the mud stream.

Loading assembly 620 includes a receiving collar 622 with a beveled sealing face for sealing contact with the beveled face of the sleeve 400. Receiving collar 622 has a vertical aperture therethrough. The vertical aperture defines a segment of the sample line 217. Receiving collar 622 includes a further aperture generally perpendicularly crossing the vertical aperture and extending through the collar 622. A journal bushing 624 is fixed in the further aperture. Journal bushing 624 has a vertical aperture coaxial with the sample line aperture in the collar 622 and a longitudinally extending center aperture that is coaxially aligned with the center aperture of drive collar 612. A sample port is defined in the bushing 624 at the intersection of the two apertures of receiving collar 622. The receiving collar 622 and bushing 624 are fixed relative to the sample line 217. A receiving plunger 626 is slideably housed in the center aperture of the bushing 624. Bushing 624 further includes a packing seal (not shown) to keep contaminants from the longitudinal aperture of the bushing. Plunger 626 has generally the same diameter as the mandrel 300 of the sample carrier 155. Plunger 626 is biased toward the drive assembly 610 (rightwardly in FIG. 6A). In an example, a spring 628 engages plunger 626 and the fixed receiving collar 622 to bias the plunger. The plunger 626, at its end that engages the sample line 217, includes two seals 631, 632 with a recess or aperture 633 intermediate the seals.

Figure 6A:
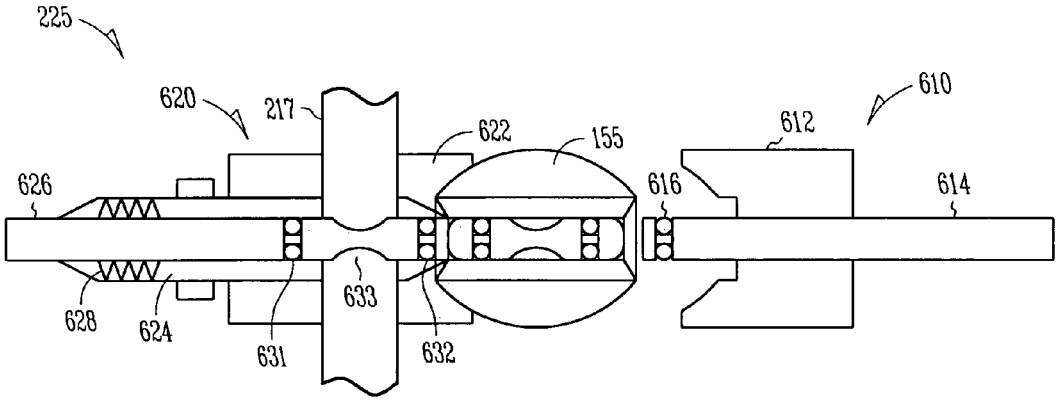
FIG. 6A illustrates a loading system for the sample carrier at a first stage, according to one embodiment of the invention.
Figure 6B:
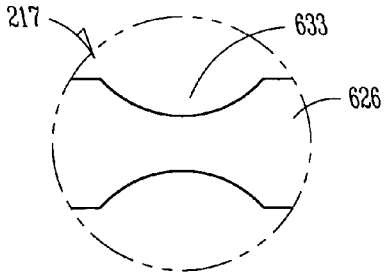
FIG. 6B illustrates an enlarged view of the sample fluid path of FIG. 6A.
Figure 7A:
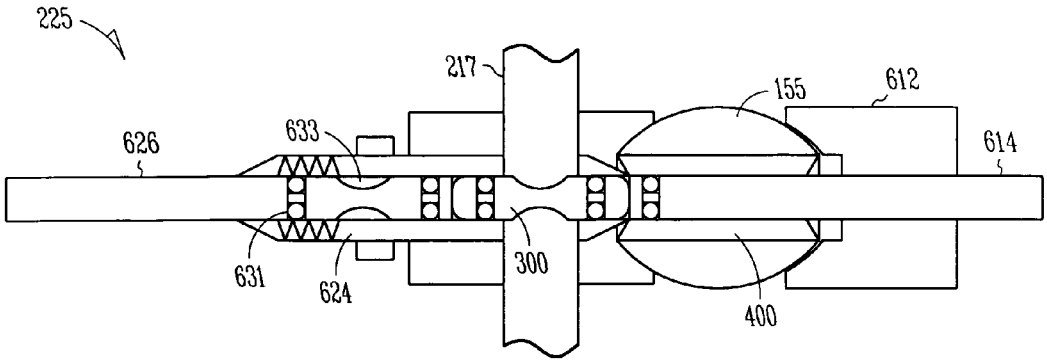
FIG. 7A illustrates a loading system for the sample carrier at a second stage, according to one embodiment of the invention.
Figure 7B:
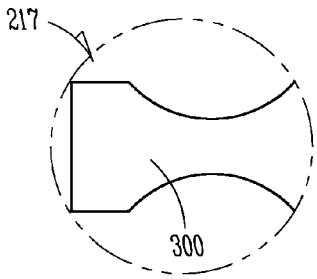
FIG. 7B illustrates an enlarged view of the sample fluid path of FIG. 7A.
Figure 8A:
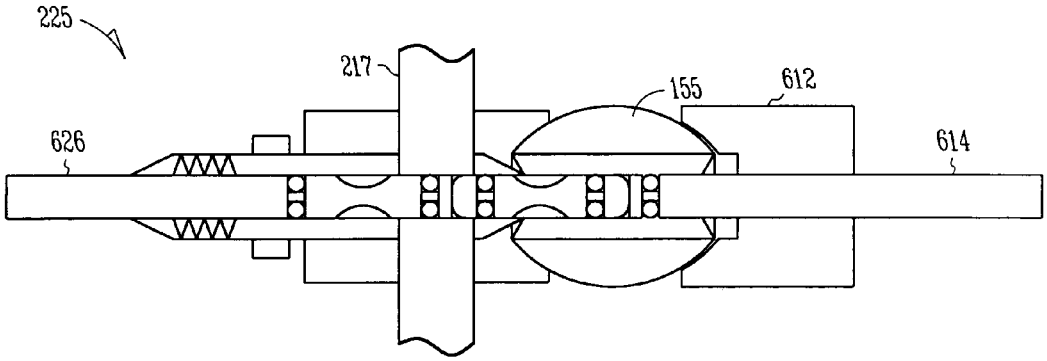
FIG. 8A illustrates a loading system for the sample carrier at a third stage, according to one embodiment of the invention.
Figure 8B:
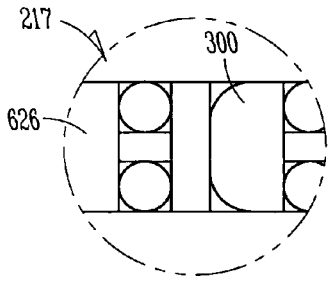
FIG. 8B illustrates an enlarged view of the sample fluid path of FIG. 8A.
Figure 9A:
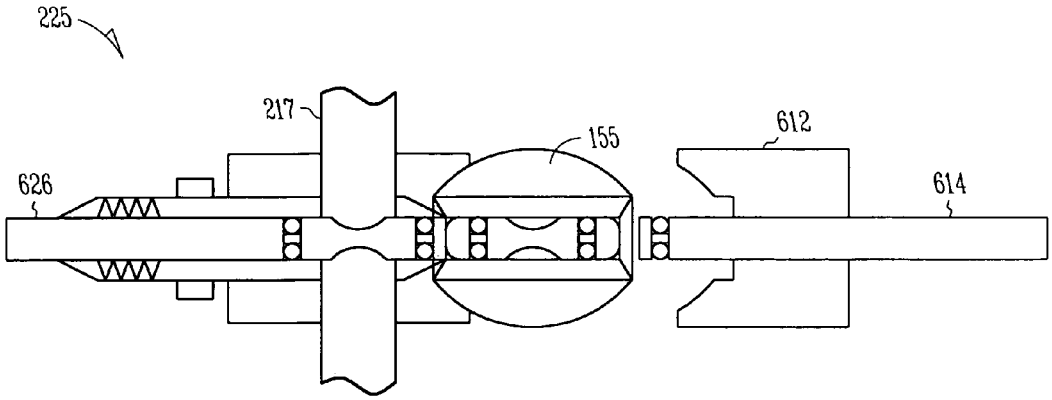
FIG. 9A illustrates a loading system for the sample carrier at a fourth stage, according to one embodiment of the invention.
Figure 9B:
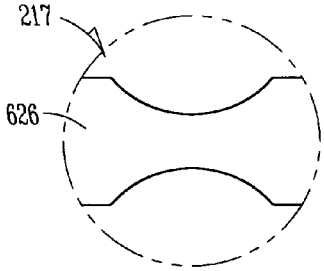
FIG. 9B illustrates an enlarged view of the sample fluid path of FIG. 9A.

It is desired that the plunger 626 not restrict the fluid transmission at the sample point. Aperture 633 allows the fluid to flow in the sample line 217 past the sample loader 625. This allows the sampling system, see e.g., 230 in FIG. 2, to control the pressure in the sample line 217 and flow sample fluids to the carrier loader 225. FIG. 6B shows an enlarged view of the sample line 217 with the plunger 626 positioning the recess 633 in the flow path. Other methods and structures are within the scope of the present invention for preventing sample line blockage at the sample point. For example, the sample line 217 at the sample point could be expanded to have an increased diameter. Moreover, other shapes for the mandrel 300 and plunger 626 could be used to reduce their effect on the sample line.

In operation, a new, unloaded sample carrier 155 is positioned intermediate the collars 612, 622. Drive assembly 610 moves laterally (leftwardly in FIG. 6A) and engages one end of the carrier 155. Drive assembly 610 continues to move carrier 155 laterally into engagement with collar 622. Collars 612, 622 each have curved faces that engage the sample carrier and center the sample carrier 155. At this point the collar 612 stops movement. Plunger 614 continues to move laterally into an open end of the sleeve 400 and contacts end of the mandrel 300. Plunger 614 drives the mandrel 300 out of sleeve 400 and into the center aperture of bushing 624. Plunger 626 resistibly yields to the mandrel 300 and allows the mandrel to travel such that the recess 310 at the mandrel waist is aligned in the sample line 217 at the sample port, see FIG. 7A, 7B. The fluid sample in line 217 fills the mandrel recess 310. The drive plunger 614 holds the mandrel in place until its recess is full of fluid. The drive plunger 614 retracts or reduces its drive force. The plunger 626 drives the mandrel 300 back into sleeve 400, see FIG. 8A. A fluid sample is now stored between the waist of the mandrel 300 and inner surface of sleeve 400. Once mandrel 300 is seated in the sleeve 400 with the recess 310 filled with sample fluid and sealed, the drive collar 612 is retracted. The sample carrier 155 is now free to be ejected from the sample loader 225 into the return mud stream.

Figure 10:
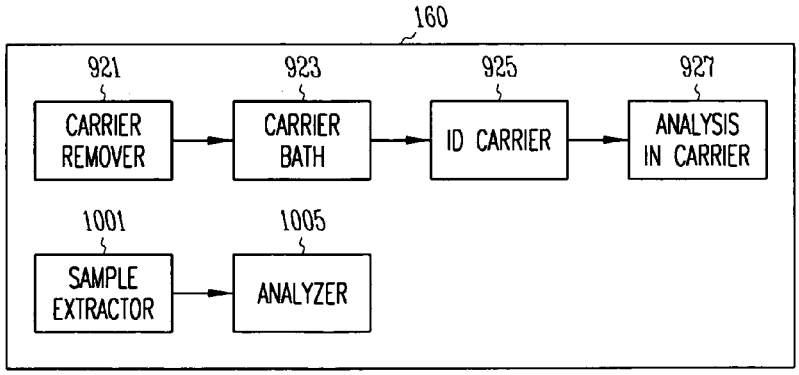
FIG. 10 illustrates a schematic view of a carrier extraction unit for removing the carrier from the drilling mud, according to an embodiment of the invention.

The mud pit 134 (FIG. 1) receives the mud and the sample carriers 155 traveling in the mud. FIG. 10 illustrates carrier extraction unit 160 that removes the sample carriers from the mud pit 134. Carrier extraction unit 160 includes a carrier remover 921. Carrier remover 921 includes, in various embodiments, a shale shaker, screens and/or jigging equipment to separate the carriers 155 from the mud. Carrier remover 921, in an embodiment, includes a fluorescent light detector to identify the fluorescent carriers in the drilling mud. Carrier remover 921 may further include a magnet, such as a strong AC magnet to attract the carriers 155 that contain metals. The unit 160 further includes a carrier cleaner 923 that cleans drilling mud from the carrier. The cleaner 923 may be a bath or shower with water and, if needed, other solvents, to remove the drilling mud.

Carrier extraction unit 160 includes an identification system 925 for identifying the carrier 155. Carriers may not arrive at the surface or be removed from the mud in the order that they were loaded with samples. The identification system 925 is a bar code reader for reading the bar code printed on the carrier, in an embodiment. The ID system 925 is an RF communication system, in an embodiment with the carrier having an RFID. The RF communication system may further download the data stored in the RFID tag. This data may include the sequential number of the carrier, the depth, the pressure, and the temperature at which the sample was taken. Moreover, the data may be data from other downhole sensors and logging equipment. That is, the carrier may be the communication system that moves the data from downhole logging. Logging includes measurement-while-drilling (MWD) and logging-while-drilling (LWD) systems that provide wellbore directional surveys, petrophysical well logs, and drilling information in essentially real time while drilling. The instrumented, sensor containing drill collar 124 (FIG. 1) is one example of an MWD or LWD system. Typically, a downhole-to-surface data telemetry system or wired communication system transmits the data to the surface. One example of a telemetry system is described in U.S. Pat. No. 6,538,576, titled "Self-Contained Downhole Sensor and Method Of Placing and Interrogating Same," assigned to the assignee of the present application, and herein incorporated by reference. The downhole tool 124 generates data that is loaded into the memory, e.g., RFID, of carrier 155 and later read at the surface. Another example of petrophysical logging measurements include gamma response for the last 100 feet of drilling.

The unit 160, in an embodiment, includes an in-carrier analysis device 927. In an embodiment, device 927 includes a scale of weighing the carrier 155 with sample. The carrier 155 may further be transparent to certain tests. In an embodiment, the carrier 155 is transparent to X-rays. In an embodiment, the carrier 155 is transparent to visible light. In the alternative, the carrier may have a distinct reading in an analysis, which allows the in-carrier analysis to be performed with a correction for the carrier reading. Examples of types of in-carrier testing include optical techniques that assess absorbance, and fluorescence. Additional examples include x-ray and infrared transmissions to determine molecular weight, SARA (Saturates, Aromatics, Resins, Asphaltenes), and heavy metals (Ni, V, Zn). Moreover, the mandrel 300 can be manufactured from a material that has a resonant frequency that allows for investigation of density and viscosity of the sample while still in the carrier.

The system 160 includes, in an embodiment, a sample extractor 1001 that removes the sample from the carrier 155 and delivers the extracted sample to an analyzer 1005. The sample extractor 1001 and analyzer are discussed in greater detail below with reference to FIGS. 11-13.

Figure 11:
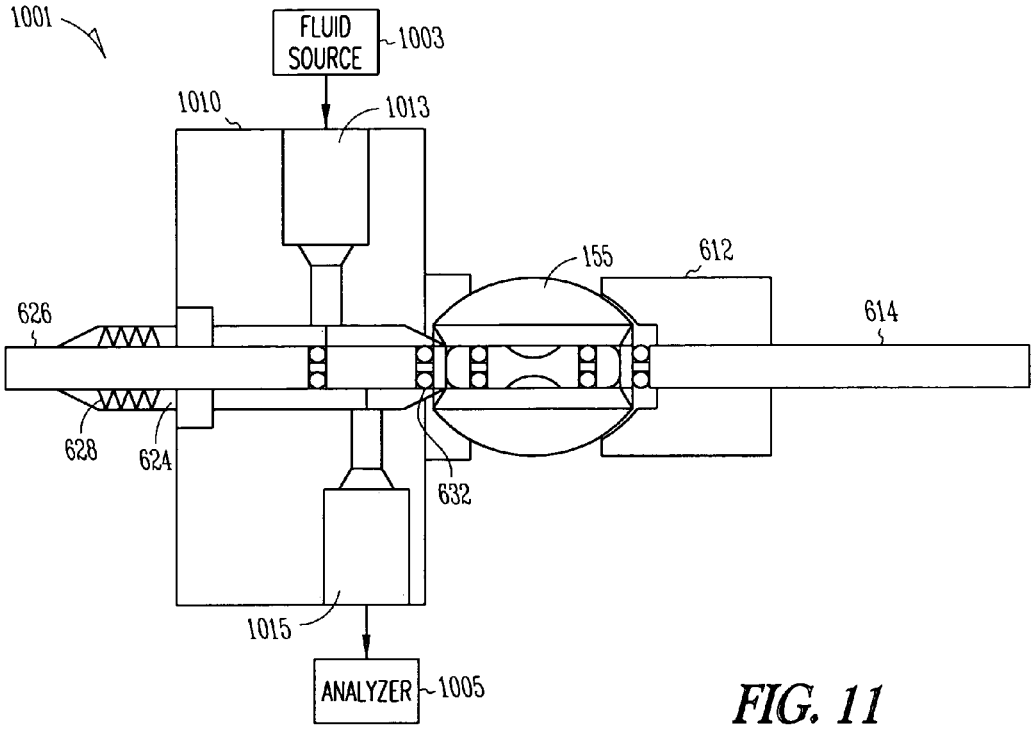
FIG. 11 illustrates an unloading system for the sample carrier at a first stage, according to one embodiment of the invention.
Figure 12:
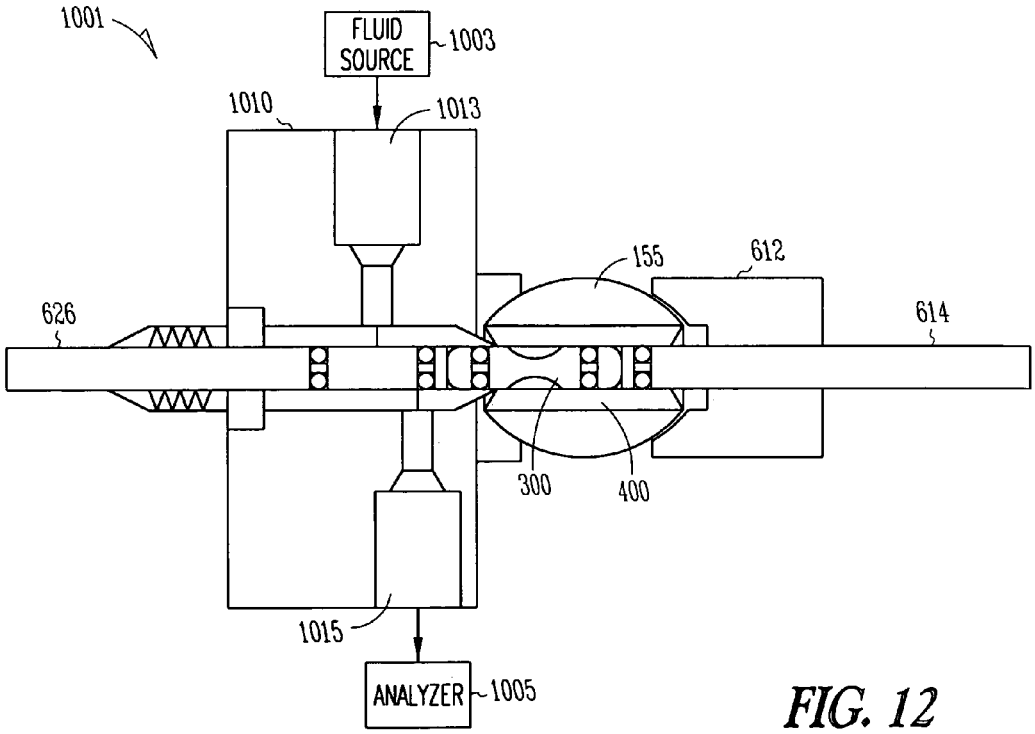
FIG. 12 illustrates an unloading system for the sample carrier at a second stage, according to one embodiment of the invention.
Figure 13:
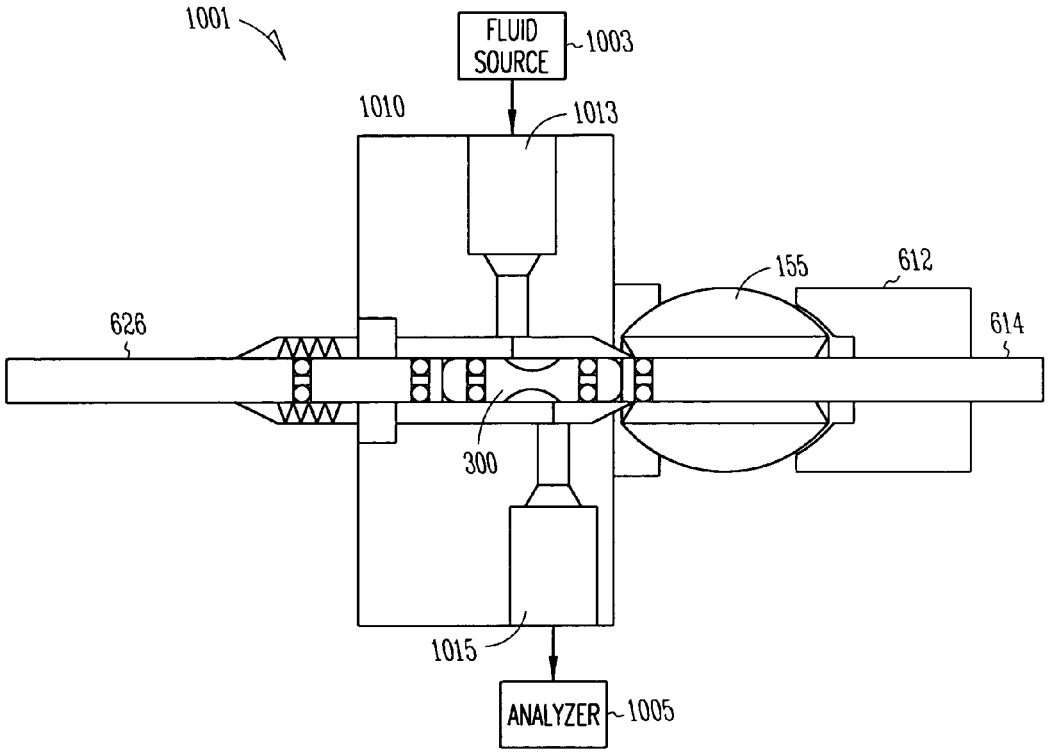
FIG. 13 illustrates an unloading system for the sample carrier at a third stage, according to one embodiment of the invention.

FIGS. 11-13 illustrate a sample extractor 1001 connected to a pressurized fluid source 1003 and a sample collector/analyzer 1005. It will be recognized that the sample extractor 1001, fluid source 1003 and analyzer 1005 are positioned at the drilling system 100 in an embodiment. Accordingly, the operations of these devices are adapted to be in the field equipment. The sample extractor 1001 is shown in various stages of removing the sample from the sample carrier 155. Elements of the sample extractor 1001 that are the same, similar, functionally equivalent, or structurally equivalent to the carrier loader 225 are identified by the same reference numbers and not discussed in detail. Sample extractor 1001 includes an extractor housing 1010 with an alignment collar 1011 for receiving and aligning the carrier 155. Housing 1010 further includes an inlet port 1013 connecting the fluid source 1003 to the center aperture of the bushing 624. An outlet port 1015 fluidly connects the bushing center aperture to the sample collector/analyzer 1005. The outlet port 1015 is positioned opposite and laterally offset from the inlet port 1013. The plunger 614 drives the mandrel 300 into the housing 101 so that the inlet port 1013 and outlet port 1015 are in fluid communication with the sample in the recess 310. The inlet port 1013 inputs an inert fluid or gas that will not react with the sample and forces the sample fluid into the outlet port 1015 and into the sample collector/analyzer 1005. The sample extractor 1001 allows the sample to be removed and held at the same pressure it was collected for certain experiments and testing. The sample extractor 1001 further can provide for a controlled release and reduction of pressure of the sample as it is removed from the carrier 155.

The analyzer 1005, in various embodiments, performs testing of formation fluid samples. As used herein fluid means both liquids and gases due to the phase changes at different pressures, volumes, and temperatures. In an embodiment, the analyzer performs gas chromatography. As the sample carrier 155 transports a sample to the surface at its sample pressure and volume, the sample need not be reconstituted to its original pressure and volume before being analyzed.

The extractor 1001, in an embodiment, removes the sample from the carrier 155 using a solvent that is used in the analysis of the sample. In an example, the source provides a solvent, such as $CS_2$ or $CCl_4$, to the inlet port 1013. The inlet port 1013 injects the solvent into the sample while moving the sample to the outlet port 1015. The outlet port 1015 moves the sample with solvent to the analyzer 1005. The analyzer 1005 performs infrared, gas composition, or molecular weight analysis. In an embodiment, the analyzer 1005 further includes a gas chromatograph.

While described above as a down hole sampling system that releases the carriers 155 into the drilling mud for return to the surface, it is within the scope of an embodiment of the present invention to store the carriers 155 down hole and retrieve the samples at a later time. For example, the sample carriers 155 are loaded as described herein and returned to their magazine. In a further embodiment, the downhole tool 124 includes a store for the sample carriers 155. An example of a store is a container in the downhole tool 124 into which the loaded carriers 225 are ejected. This container could be a box fixed to the outer wall of the downhole tool 124 that does not interfere with the drill string 108. In this example, the carriers 155 are retrieved after each bit run after the downhole tool 124 returns to the surface.

The present disclosure provides methods and apparatus for collecting, preserving, identifying, retaining, transporting to the surface, and analyzing fluid samples from subterranean formations. The apparatus may have numerous carriers 155 that allow sampling at regular intervals while drilling. For example, a sample could be taken every X feet, e.g., every 10 or 100 feet. In other applications, the sampling may be done at a greater frequency at certain formations. The sample carriers 155 can be color coded or numbered such that they are identifiable with the bore location whereat each individual sample carrier was loaded with a sample. Sampling may be skipped at other formations depending on the formation and other data. The present sampling provided the opportunity to make drilling related decisions and reservoir management decisions at the drill site as the samples are retrieved at the drill site and can be analyzed at the drill site using equipment that only needs to be field hardened and not downhole compatible. For example, well casing options can be determined at the time the well is being drilled to prevent permanently sealing a possibly promising formation on the way past this formation. This decision can be made based on samples provided as described herein. The present sampling system should reduce the number of drill stem tests. Accordingly, the pace of drilling is increased by removing some drill down time, which should reduce drilling costs.

Figure 14:
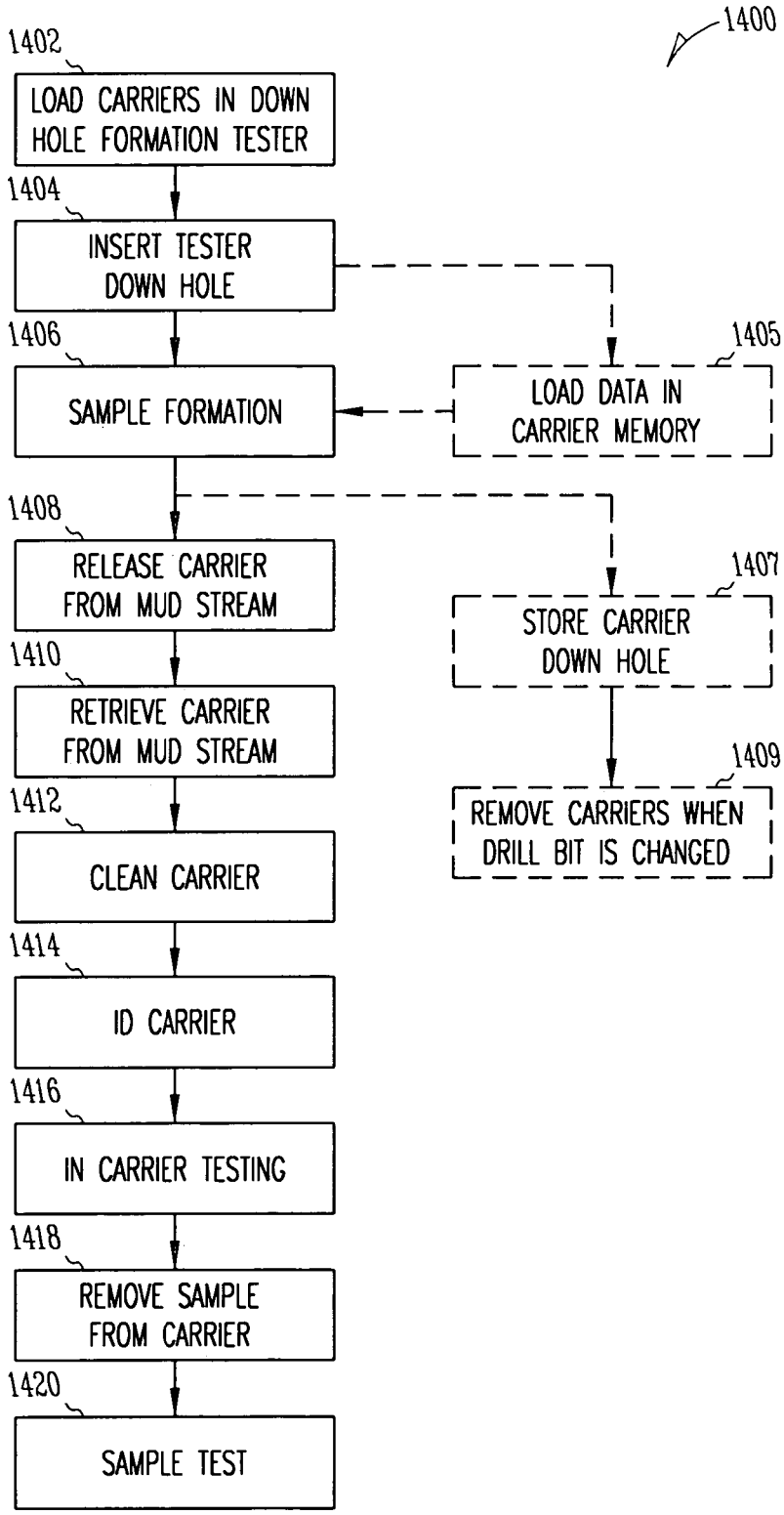
FIG. 14 illustrates a flow chart of a method according to an embodiment of the present invention.

FIG. 14 illustrates a flow chart of a method 1400 according to an embodiment of the present invention. It will be understood that methods, processes, functions and/or steps described herein can be used with the method described in with FIG. 14. Method 1400 starts with step 1402 wherein the carriers are loaded into a bore hole formation tester. The carriers can be in a magazine that will individually feed the carriers. The formation tester is inserted into the bore hole, 1404. The formation tester may be inserted with other testing apparatus in a wire line tester. The formation tester may be part of a drill string to provide sampling while drilling. In one embodiment, the sample carriers are adapted to store data. For example, the carriers include electrical or magnetic storage. Data is loaded into the carrier storage 1405. The formation tester samples the formation and inserts a sample or additional data into the carrier, 1406. In an embodiment, the carrier is returned to the magazine and stored downhole, 1407. The carriers with samples and/or data are retrieved when the formation tester is removed from the bore hole and returns to the surface. In an example, the drill string is removed to change the drill bit, the loaded carriers are removed from the formation tester. In an embodiment, the carrier with a sample and/or data is released into the mud flow in the bore hole, 1408. The carriers travel in the mud to the surface. The carriers are retrieved from the drill mud, 1410. The carriers are cleaned, 1412, and identified 1414. Identification of the carriers can be accomplished by reading identifiers as described herein. Certain testing is performed with the sample in the carrier, 1416. The sample is then removed from the carrier, 1418. Additional testing can now be performed on the sample brought to the surface in the carrier.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In view of the wide variety of permutations to the embodiments described herein, this detailed description is intended to be illustrative only, and should not be taken as limiting the scope of the invention. What is claimed as the invention, therefore, is all such modifications as may come within the scope and spirit of the following claims and equivalents thereto. Therefore, the specification and drawings are to be regarded in an illustrative rather than a restrictive sense.

What is claimed is:

1. A sample carrier to retrieve a sample out of a borehole, comprising:

a shell including an interior hollow, wherein the shell includes a sleeve and a jacket surrounding the sleeve, and wherein the jacket and sleeve are buoyant in drilling mud;

a mandrel having a sample receiving recess between two sealing assemblies and adapted to move in the interior hollow of the shell to allow sample entry into a sample chamber defined by the sample receiving recess and the interior hollow and to seal the sample chamber to retain a volume of a formation fluid; and wherein the shell with the mandrel therein is adapted to travel out of a borehole.

2. The sample carrier of claim 1, wherein the sleeve and the mandrel form a sealable volume there between to hold a formation fluid sample.

3. The sample carrier of claim 1, wherein the mandrel includes seals for contact with the sleeve to seal the volume.

4. The sample carrier of claim 1, wherein the jacket includes an identifier.

5. The sample carrier of claim 4, wherein the identifier is a fluorescent material.

6. The sample carrier of claim 4, wherein the identifier is a radio frequency identification.

7. The sample carrier of claim 4, wherein the identifier is a bar code.

8. The sample carrier of claim 4, wherein the identifier is a color code to indicate at least one of the depth of use of the carrier and the order of use of the carrier.

9. The sample carrier of claim 1, wherein the volume is about 70 microliters.

10. The sample carrier of claim 1, wherein the shell has a generally spheroid shape.

11. The sample carrier of claim 1, wherein the shell includes means for identifying the carrier and means for non-intrusively traveling in drilling mud.

12. A sample carrier to retrieve a sample out of a borehole, comprising:

a shell having an interior hollow;

a mandrel having a recessed portion between two sealing assemblies adapted to seal the interior hollow to retain a volume of a formation fluid, and wherein the mandrel is transparent to a signal used in testing the sample in the volume.

13. The sample carrier of claim 12, wherein the shell includes a sleeve and a jacket surrounding the sleeve, and wherein the jacket and sleeve are buoyant in drilling mud.

14. The sample carrier of claim 13, wherein the sleeve and the mandrel form a sealable volume there between to hold a formation fluid sample.

15. The sample carrier of claim 14, wherein the mandrel includes seals for contact with the sleeve to seal the volume.

16. The sample carrier of claim 15, wherein the jacket includes an identifier.

17. The sample carrier of claim 16, wherein the identifier is a fluorescent material.

18. The sample carrier of claim 16, wherein the identifier is a radio frequency identification.

19. The sample carrier of claim 16, wherein the identifier is a bar code.

20. The sample carrier of claim 16, wherein the identifier is a color code to indicate at least one of the depth of use of the carrier and the order of use of the carrier.

21. A sample carrier to retrieve a sample out of a borehole, comprising:

a shell having an interior hollow;

a mandrel adapted to seal the interior hollow with a volume of a formation fluid, and wherein the mandrel includes a coating to adhere to a specific chemical that may be found in the formation.

22. A formation sampling system, comprising:

a sample loading assembly adapted to be operative downhole and to repeatedly engage a formation wall of a borehole; and a plurality of sample carriers to be loaded by the sample loading assembly and to be released into drilling mud, each sample carrier comprising:

a sleeve defining a cavity;

a mandrel sized to fit within the cavity and including a sampling recess between two sealing assemblies, the mandrel adapted to move within the cavity to receive fluid within a sample chamber defined by the sampling recess and the cavity, the fluid received from the sample loading assembly, and the mandrel further adapted to seal the sample chamber to retain the received fluid.

23. The system of claim 22, each sample carrier further comprising a jacket portion that is buoyant relative to drilling mud within the bore hole, wherein the sleeve and the jacket portion form a shell.

24. A formation sampling system, comprising:

a sample loading assembly adapted to be operative downhole;

a sample carrier to be loaded by the sample loading assembly and released into drilling mud;

wherein the sample carrier includes a shell having an interior hollow and a mandrel including a sample receiving recess between two sealing assemblies, the mandrel adapted to move within the interior hollow to receive a formation fluid sample and to seal the interior hollow with to retain a volume of the formation fluid sample in the interior hollow;

wherein the sample loading assembly is adapted to load the formation fluid sample; and wherein the sample loading assembly includes a carrier loader adapted to remove the mandrel from the shell, expose the sample receiving recess to the fluid sample, and reinsert the mandrel into the shell.

25. The system of claim 24, wherein the shell is buoyant in drilling mud and includes a sleeve and a jacket surrounding the sleeve, wherein the two sealing assemblies are adapted to contact the sleeve to retain the formation fluid sample.

26. The system of claim 25, wherein sample loading assembly includes a formation fluid extracting device operatively coupled to the carrier loader, the extracting device being adapted to engage the formation wall and extract a sample.

27. The system of claim 26, wherein the formation fluid extracting device includes a sample line to deliver the sample to the carrier loader and includes a pressure system to extract fluids from the formation.

28. The system of claim 27, wherein the formation fluid extracting device includes a seal to engage the formation wall, a snorkel within the seal to remove a sample from the formation, and a sampling system controller to control the seal and the snorkel.

29. The system of claim 28, wherein the sample line is in fluid communication with the carrier loader.

30. The system of claim 29, wherein the carrier loader includes a downhole power source.

31. The system of claim 30, wherein the formation fluid extracting device includes a downhole power source.

32. The system of claim 30, further comprising an extraction device for removing the sample carrier from the drilling mud.

33. The system of claim 32, wherein the extraction device is positioned at the surface and includes mechanical devices to remove the sample carrier.

34. The system of claim 32, wherein the extraction device includes a cleaner to remove the drilling mud from the sample carrier.

35. The system of claim 32, wherein the sample carrier includes a radio frequency memory, and wherein the extraction device includes a radio frequency device to read the memory in the sample carrier.

36. The system of claim 32, wherein the extraction device includes an analyzer to test the sample from the sample carrier.

37. A method of sampling a borehole, the method comprising:

engaging a wall with a formation tester;

extracting a sample;

inserting the sample in a carrier comprising a sleeve defining a cavity and a mandrel sized to fit within the cavity, the mandrel including a sample receiving recess between two sealing assemblies, the mandrel positionable relative to the sleeve to expose the sample receiving recess to the extracted sample;

moving the mandrel within the cavity of the sleeve to seal the extracted sample within the sleeve; and retrieving the sample from the carrier outside the bore hole, wherein retrieving the sample from the carrier includes identifying material attached to a coating on the sample carrier.

38. The method of claim 37, wherein retrieving the sample includes releasing the carrier with the sample into a mud flow in the borehole, and removing the carrier from the mud flow outside the borehole.

39. The method of claim 37, wherein inserting the sample in the carrier comprises sliding the mandrel from inside a housing to expose the sample receiving recess in the mandrel.

40. The method of claim 37, wherein moving the mandrel comprises sliding the mandrel into the sleeve.

41. The method of claim 37, wherein retrieving the sample from the carrier outside the borehole includes identifying the carrier, performing a sample test on the sample in the carrier, and removing the sample from the carrier.

42. A method of sampling a borehole, comprising:

engaging a formation wall with a formation tester;

extracting a sample;

inserting the sample in a carrier, the carrier including a shell having a cavity and a mandrel sized to fit within the cavity, the mandrel including a sample receiving recess between two seals adapted to define a sample receiving chamber relative to the shell;

retrieving the sample from the carrier outside the borehole; and wherein extracting a sample includes forming a seal at a sample location of the bore hole and fluidly connecting a sample line to the sealed sample location.

43. The method of claim 42, wherein fluidly connecting a sample line includes reducing pressure in the sample line relative to pressure in the formation.

44. The method of claim 43, wherein inserting the sample in the carrier includes exposing the sample receiving chamber to the sample line.

* * * * *

UNITED STATES PATENT AND TRADEMARK OFFICE

CERTIFICATE OF CORRECTION

PATENT NO. : 7,775,276 B2
APPLICATION NO. : 11/367924
DATED : August 17, 2010
INVENTOR(S) : Michael T. Pelletier et al.

It is certified that error appears in the above-identified patent and that said Letters Patent is hereby corrected as shown below:

In column 13, line 53, in Claim 3, delete "claim 1" and insert -- claim 2 --, therefor.

Signed and Sealed this
Twenty-eighth Day of December, 2010

David J. Kappos

David J. Kappos
*Director of the United States Patent and Trademark Office*